US008541722B2

(12) United States Patent
Lauth et al.

(10) Patent No.: US 8,541,722 B2
(45) Date of Patent: Sep. 24, 2013

(54) ELECTRICAL HEATER AND METHOD FOR MANUFACTURING AN ELECTRICAL HEATER

(75) Inventors: Arno Lauth, Ranschbach (DE); Frank Kamy, Hayna (DE); Armin Lang, Barbelroth (DE); Jürgen Stritzinger, Freckenfeld (DE)

(73) Assignee: Eichenauer Heizelemente GmbH & Co. KG, Kandel (DE)

( * ) Notice: Subject to any disclaimer, the term of this patent is extended or adjusted under 35 U.S.C. 154(b) by 197 days.

(21) Appl. No.: 13/016,631

(22) Filed: Jan. 28, 2011

(65) Prior Publication Data

US 2011/0186564 A1 Aug. 4, 2011

(30) Foreign Application Priority Data

Jan. 29, 2010 (DE) ..... 10 2010 006 184

(51) Int. Cl.
*H05B 3/10* (2006.01)
*H05B 3/34* (2006.01)

(52) U.S. Cl.
USPC ..... 219/548; 219/544

(58) Field of Classification Search
USPC ..... 219/538–549, 552, 553, 504, 505; 338/22 R, 226, 227, 230, 238–243
See application file for complete search history.

(56) References Cited

U.S. PATENT DOCUMENTS

| | | | | |
|---|---|---|---|---|
| 4,822,980 | A * | 4/1989 | Carbone et al. | 392/453 |
| 5,598,502 | A * | 1/1997 | Takahashi et al. | 392/502 |
| 5,720,556 | A * | 2/1998 | Krellner | 374/185 |
| 6,180,930 | B1 | 1/2001 | Wu | |
| 6,847,017 | B2 * | 1/2005 | Starck et al. | 219/534 |

FOREIGN PATENT DOCUMENTS

| | | | |
|---|---|---|---|
| DE | 3730161 | A1 | 3/1989 |
| DE | 10258257 | A1 | 7/2003 |
| EP | 1414275 | A1 | 4/2004 |
| EP | 1523224 | A1 | 4/2005 |
| EP | 1646055 | A1 | 4/2006 |

OTHER PUBLICATIONS

Machine English translation of DE 3730161.*
European Search Report (in German language), European Patent Application No. 11 15 1472, dated May 11, 2011, 6 pages.
German Search Report, German Patent Application No. 10 2010 006 184.0, dated Dec. 21, 2010, 4 pages.

* cited by examiner

*Primary Examiner* — Sang Paik
(74) *Attorney, Agent, or Firm* — Fitch, Even, Tabin & Flannery LLP

(57) ABSTRACT

The invention relates to an electrical heater with a tubular housing and with a heating insert inserted in the housing. The heating insert includes at least one PTC thermistor. Herein, at least one concave indentation is formed in the housing, which is at least punctually in contact with a corresponding concave indentation of the heating insert. Furthermore, the invention relates to a method for manufacturing such an electrical heater.

15 Claims, 2 Drawing Sheets

ELECTRICAL HEATER AND METHOD FOR MANUFACTURING AN ELECTRICAL HEATER

CROSS-REFERENCE TO RELATED APPLICATION

This application claims foreign priority under 35 U.S.C. §119 to German Patent Application No. 10 2010 006 184.0, filed Jan. 29, 2010, which is hereby incorporated herein by reference in its entirety.

FIELD OF THE INVENTION

The invention relates to an electrical heater with a tubular housing and with a heating insert inserted in the housing. The heating insert has at least one PTC thermistor. Furthermore, the invention relates to a method for manufacturing such an electrical heater.

BACKGROUND OF THE INVENTION

EP 1 414 275 B1 describes an electrical heater with a tubular housing, which surrounds a heating insert. The heating insert includes a PTC thermistor, which is also referred to as a PTC heating element, since the PTC thermistor has a positive temperature coefficient (PTC=positive temperature coefficient). Thus, the electrical resistance of the PTC thermistor increases with increasing temperature such that it limits the temperature to the top in a self-regulating manner. The heating insert also includes two heat transfer means, wherein the PTC thermistor is disposed between the two heat transfer means. Viewed in radial direction the PTC thermistor is disposed between the two heat transfer means. The heat transfer means transfer the thermal heat of the PTC thermistor to the housing. Each of the two heat transfer means has a flat basic part on its side facing the PTC thermistor, on which two bent legs are disposed. The legs abut an inner wall of the housing in the manner of a flexible spring with the heating insert inserted in the housing. By the resilience of the legs, good abutment of the heat transfer means on the housing and thus good heat transfer from the PTC thermistor to the housing is provided.

In an electrical heater described in DE 102 58 257 A1, the abutment of the heating insert on the inner wall of the housing is accomplished by first inserting the heating insert into the housing—rectangular in cross-section—and then compressing the housing. This subsequent compression of opposing sides of the housing is also referred to as lateral press-fitting. Herein, the housing is made of an aluminum alloy.

U.S. Pat. No. 6,180,930 B1 relates to an electrical heater with a heating insert, which only includes a PTC thermistor and two contact electrodes in a common electrically isolating envelope. This heating insert is inserted in a housing of aluminum or copper—also rectangular in cross-section. The two opposing side walls of the housing are moved towards each other by compressing the housing in order to clamp the heating insert between them. The two side walls not pressurized, which may be concave or convex, are formed in deformable manner in order to be able to accommodate the loading upon compressing the housing.

However, limitations are imposed on the above described possibilities of placing the heating insert in contact with the housing as close as possible. In a comparatively long tubular housing and correspondingly comparatively long heating insert, it is difficult to insert the heating insert into the housing, if it is resiliently supported on the inner side of the housing. By subsequently compressing opposing sides of the housing, a completely satisfactory heat transfer also cannot always be ensured.

Therefore, it is the object of the present invention to provide an electrical heater and a method of the initially mentioned type, in which or by which a particularly good heat transfer from the heating insert to the housing is present even with a comparatively long housing.

This object is solved by an electrical heater having the features of claim 1 and by a method having the features of claim 11. Advantageous configurations with convenlent developments of the invention are specified in the dependent claims.

BRIEF SUMMARY OF THE INVENTION

In the electrical heater according to the invention with a tubular housing and with a heating insert inserted in the housing, the heating insert has at least one PTC thermistor. The housing has at least one concave indentation, which is at least punctually in contact with a corresponding concave indentation of the heating insert. A transition region, in which a curvature (optionally also having the value of zero) of the housing varies due to the presence of the indentation, is presently to be considered as associated with the indentation. The at least punctual contact between the housing and the heating insert can also be formed as a contact region according to the configuration of the indentations. Furthermore, presently, an indentation with a gradient, which is non continuous, and which thus has at least one—in particular orthogonal—kink, is to be considered as a concave indentation. Herein, the at least one indentation provided on the heating insert allows to form a deeper indentation into the housing than it would be the case in a heating insert, which has a diameter substantially constant at least in one direction.

By forming the at least one concave indentation into the housing, after inserting the heating insert into the housing, a plane contact between the heat transfer means and the inner side of the housing can be achieved. Namely, by introducing housing material into the concave indentation of the heating insert—appearing upon forming the indentation into the housing—a distance between the heat transfer means and the inner side of the housing in regions of the heat transfer means different from the indentation can be reduced to a very low value, in particular to a value of zero. Thus, the housing contracts around the heating insert by forming the indentation into the same. Thus, the housing and the heating insert abut each other under pressure and ensure good heat transfer from the PTC thermistor to the housing.

Thereby, a particularly good heat transfer from the heating insert to the housing is present, and yet even a comparatively long heating insert can be inserted into a—similarly comparatively long—housing without difficulty. The internal diameter of the tubular housing can be selected greater than the maximum external diameter of the heating insert, since the internal diameter of the tubular housing can be reduced by subsequently forming the concave indentation. As soon as the concave indentation of the housing is in contact with the corresponding concave indentation of the heating insert, the heating insert is secured against positional change, and at the same time, high contact pressure of the housing on the heating insert is established. The concave indentation of the housing can be produced by means of a punch of a press or—if the indentation is formed by rolling-in—by pressurizing the housing via a roller.

DETAILED DESCRIPTION OF THE INVENTION

In an advantageous development of the invention, the at least one concave indentation of the housing is formed as a bead. Namely, upon forming the indentation into the housing, more housing material can be inserted in such a groove-shaped recess than in a merely punctual indentation. Thereby, the close contact of the at least one heat transfer means with the inner side of the housing can be ensured via a particularly great length of the tubular housing.

The concave indentation of the heating insert can be formed in the PTC thermistor itself. Alternatively, a clearance open towards the housing between at least two components of the heating insert can also provide the concave indentation thereof.

However, it has proved to be advantageous, if the heating insert has at least one heat transfer means adapted to transfer heat of the at least one PTC thermistor to the housing, wherein the at least one concave indentation of the heating insert is formed in the at least one heat transfer means. Namely, the heat transfer means can be particularly simply and precisely formed as a profile part, in which the formation of a concave indentation, like in the form of a groove, can be realized in particularly easy and inexpensive manner. In addition, with regard to the configuration of the further components of the heating insert, a particularly great flexibility is thus present. In particular, standardized and readily available further components can thus be used for the heating insert.

In a preferred embodiment of the invention, the housing is formed of steel. Namely, this material is particularly well suitable for forming the at least one concave indentation by plastic deformation, without resilient spring-back and thus reduction of the contact pressure exerted by the housing on the heating insert is present. The use of steel, in particular of stainless steel, for the housing moreover allows the employment of the electrical heater for heating an aggressive and/or corrosive medium. For instance, such a field of application of the electrical heater can be present if an aqueous urea solution is to be heated or thawed or if ammonia bound in solid or salt is to be evaporated, which can be employed in reduction of the nitric oxide content in exhaust gases of an internal combustion engine. Upon heating a calcareous medium by means of the heater, in addition—for instance compared to an aluminum alloy as the material for the housing—a lower risk of permanent accumulation of lime on the housing is present, if steel, in particular stainless steel, is used for the housing.

If the housing has circular-cylindrical end regions, it is particularly simple to provide a round bottom part and a round closure part, by which the end regions can be closed. Namely, parts readily available as standard can be employed. In particular upon use of steel for the tubular housing, the bottom part can be connected to the tubular housing by welding in one of the end regions. However, soldering or adhering the bottom part to one of the end regions is also conceivable.

It has proven to be further advantageous if a length of the concave indentation of the housing is smaller than an axial length of the housing. Thus, the concave indentation only has to be formed into the housing where the heating insert is actually present, wherein the heating insert usually is shorter than the housing.

If the heating insert includes at least two heat transfer means spaced from each other in radial direction, between which the at least one PTC thermistor is disposed, a particularly good heat transfer from the PTC thermistor to the housing is allowed. This is in particular true if the PTC thermistor is centrally disposed between the two heat transfer means. Herein, heat transfer means similar to each other in shape and dimension are preferably disposed such that they receive the at least one PTC thermistor between them. Namely, standard parts can thus be used for the heat transfer means.

In a further advantageous development of the invention, the heating insert has at least two heat transfer means, which are disposed spaced from each other in axial direction in the housing. This is in particular advantageous if materials are used for the heat transfer means and for the housing, which have different thermal expansion coefficients. For example, this is the case upon use of an aluminum alloy for the heat transfer means and use of steel or stainless steel for the housing. By the very much larger thermal expansion coefficient of aluminum, over time, decrease of the contact pressure could occur, which is exerted by the housing on the heat transfer means, if only a single, non-discontinuous heat transfer means is disposed in the housing over the axial length thereof. However, if space is available for the heat transfer means in axial direction, thus, the undesired influence of differently large thermal expansion coefficients can be better controlled.

It is additionally or alternatively conceivable to configure the heat transfer means not solidly, but to provide it with perforations, ribs and/or cavities. Thus, advantageously, material can in addition be saved.

However, the use of at least two heat transfer means spaced from each other in axial direction, is also advantageous because PTC thermistors usually have larger manufacturing tolerances than the heat transfer means. If several differently thick PTC thermistors or a PTC thermistor, the thickness of which varies over its length, are present—viewed over the axial length of the housing—thus, several, separate heat transfer means can better establish a flat contact with the PTC thermistor. In contrast, if the heating insert had only a single heat transfer means, it could only very difficultly compensate for different thicknesses of the PTC thermistor.

It has proven to be further advantageous if the heating insert includes at least one mounting rack. The individual components of the heating insert, like the PTC thermistors and the heat transfer means, can be well positioned and/or fixed in their relative position to each other via such a mounting rack. This facilitates the insertion of the heating insert into the housing. In particular, the mounting rack can be connected to a contact element, for instance by means of a plastic injection molding process, which serves for supplying the at least one PTC thermistor with current. Thereby, this component of the heating insert is already fixed to the mounting rack, before for instance PTC thermistor and the heat transfer means are disposed on the mounting rack. Separate mounting racks can also be provided for different components of the heating insert, which in particular can be formed capable of being coupled to each other, in order to ensure a particularly good cohesion of the components of the heating insert.

If the housing has a joining seam, in particular a weld seam, it is reasonable to form the at least one concave indentation into the housing spaced from the joining seam. Namely, a weak spot of the housing is thus omitted from the application of force upon forming the indentation.

In the method according to the invention for manufacturing an electrical heater, a heating insert is inserted into a tubular housing, which has at least one PTC thermistor. Herein, the at least one concave indentation is formed into the housing such that the indentation is contacted with a corresponding concave indentation of the heating insert at least in regions.

The advantages and preferred embodiments described for the electrical heater according to the invention also apply to the method according to the invention for manufacturing such an electrical heater, and vice versa.

In an advantageous development of the invention, the at least one concave indentation is formed into the housing by pressurizing the housing, wherein a direction, in which the pressure is applied, coincides with a development direction of the at least one concave indentation. Therein, a tool exerts pressure on the housing in the region of the indentation of the heating insert towards the indentation and thus forms the indentation of the housing. Hereto, the width of the tool is smaller than the width of the indentation of the heating insert. In this manner, pressing of the housing to the heating insert can be permanently accomplished by forming the at least one concave indentation fixing the heating insert in its position.

Advantageously, the at least one concave indentation is formed into the housing by deepening an indentation already present in the housing before inserting the heating insert. In this case, the development direction of the at least one indentation is equal to the direction, in which the already present indentation is deepened. The indentation present before inserting the heating insert can serve as a guide and facilitate the exact positioning of the heating insert upon inserting into the housing.

Finally, it has proven to be advantageous if a pressure exerted on the housing is monitored upon forming the at least one concave indentation into the housing. Namely, the indentation, in particular a bead, can thus be increasingly deepened until a preset value of the pressure exerted on the housing is reached. In presence of this pressure, then, a correspondingly high contact pressure of the housing on the heating insert can be assumed. In this manner, manufacturing tolerances of the heating insert can be particularly well considered and yet a consistently high contact pressure can be ensured.

The features and feature combinations mentioned above in the description as well as the features and feature combinations mentioned below in the description of figures and/or shown in the figures alone are usable not only in the respectively specified combination, but also in other combinations or else alone without departing from the scope of the invention.

BRIEF DESCRIPTION OF THE DRAWINGS

Further advantages, features and details of the invention are apparent from the claims, the following description of preferred embodiments as well as by way of the drawings. There show:

DETAILED DESCRIPTION OF A PREFERRED EMBODIMENT

Figure 1:
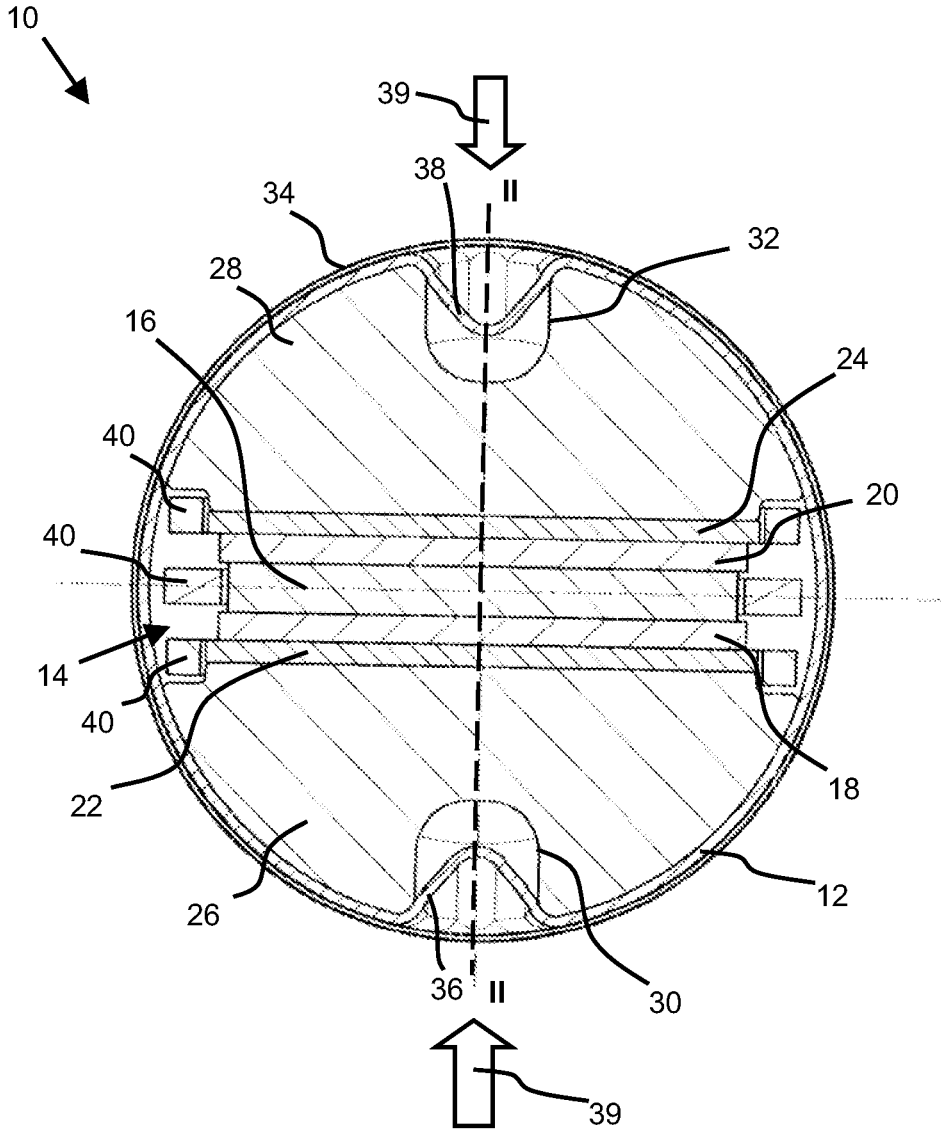
FIG. 1 in an enlarged illustration a cross-section through an electrical heater with a heater insert inserted in a housing.

An electrical heater 10 shown in FIG. 1 includes a housing 12, which is formed of a stainless steel, for example of a rustproof stainless steel. With a diameter of 20 mm, a wall thickness of the same can be 0.3 mm to 0.5 mm. A heating insert 14 is in the housing 12, which includes a PTC thermistor 16. the PTC thermistor 16 can be formed of barium titanate and has a positive temperature coefficient (PTC=positive temperature coefficient). Such a PTC heating element of barium titanate is characterized by an increasing electrical resistance with increasing temperature. For supplying the PTC thermistor 16 with electrical current, two plate-shaped contact electrodes 18, 20 are provided, between which the PTC thermistor 16 is disposed. The contact electrodes 18, 20 can be formed of a brass alloy. A nickel-plated brass alloy can also be employed.

Ceramic isolators 22, 24, which are also formed plate-shaped, electrically isolate the contact electrodes 18, 20 from two profile parts 26, 28. The isolators 22, 24, can be formed of alumina. Alternatively, the isolators 22, 24 can also be directly applied to the contact electrodes 18, 20, e.g. by overmolding. A further possibility is in providing a plastic foil for instance of Kapton® for electrical isolation. The profile parts 26, 28 ensure the heat transfer from the PTC thermistor 16 to the housing 12. The two profile parts 26, 28 are presently formed of an aluminum alloy. The heating insert 14 thus includes the PTC thermistor 16, the contact electrodes 18, 20, the isolators 22, 24 and the profile parts 26, 28 among other things.

The profile parts 26, 28 substantially have the shape of a circular segment in cross-section, wherein in a region of the circular segment opposing the PTC thermistor 16, a U-shaped groove 30, 32 is respectively formed in each of the profile parts 26, 28. Before inserting the heating insert 14 into the housing 12, the housing 12 has a circular-cylindrical configuration, wherein an outer circumference of this circular-cylindrical housing 12 is represented by a line 34 in FIG. 1. Thus, before inserting the heating insert 14, the internal diameter of the housing 12 is sized such that the heating insert 14 can be inserted into the housing 12 without difficulty. This is even the case, if the housing 12 has a particularly large axial length and a—similarly comparatively long—heating insert 14 is to be inserted into it.

The abutment of the profile parts 26, 28 of the heating insert 14 on the inner side of the housing 12 is effected subsequently, namely by punching two beads 36, 38 into the housing 12. The beads 36, 38 are formed into the housing 12, where the grooves 30, 32 of the profile parts 26, 28 are located. A development direction 39 of the beads 36, 38 is exemplified in FIG. 1 by arrows and corresponds to the direction of the pressure, which is applied to the previously circular-cylindrical housing 12—for instance by means of a punch of a press or by means of a roller—in order to form the beads 36, 38 into the housing 12.

By punching the beads 36, 38 into the housing 12, the internal diameter of the housing 12 decreases and a flat abutment of the regions of the profile parts 26, 28 in the shape of an arc of a circle on the inner side of the housing 12 is achieved. By applying a high contact pressure, thus, a good heat transfer from the profile parts 26, 28 to the housing 12 is achieved, when the PTC thermistor 16 is supplied with current.

In alternative embodiments, instead of the presently shown two beads 36, 38 opposing each other in radial direction, only one concave indentation can also be provided to effect pressing of the housing 12 to the heating insert 14.

Similarly, the arrangement and formation of the remaining components of the heating insert 14 can depart from that presently exemplarily shown. Thus, instead of the two contact electrodes 18, 20, only one electrode can be in (flat) contact with the PTC thermistor 16, wherein a further electrode can be provided as a potential connection by a metallic conductor connected to one of the profile parts 26, 28 and/or by the housing 12.

For positioning components of the heating insert 14 relatively to each other, presently, a (schematically shown) mounting rack 40 is provided, by which a retaining frame for the isolators 22, 24, the contact electrodes 18, 20, the PTC thermistor 16 and the profile parts 26, 28 is provided. This facilitates the insertion of the heating insert 14 into the housing 12.

Upon inserting the heating insert 14 into the housing 12, in addition, an inserting device (not shown) can be employed, which additionally to the mounting rack 40 can provide for cohesion of the remaining components of the heating insert 14. The inserting device can provide for an axial positioning of the heating insert 14 upon inserting the heating insert 14 into the housing 12, without having to provide an end stop in the housing 12. However, it is also conceivable to provide an end stop by the mounting rack 40, which presets the desired insertion depth of the heating insert 14 in the housing 12. After inserting the heating insert 14, then, the two beads 36, 38 are punched into the housing 12, for instance by means of the punch of the press or by means of the roller.

Figure 2:
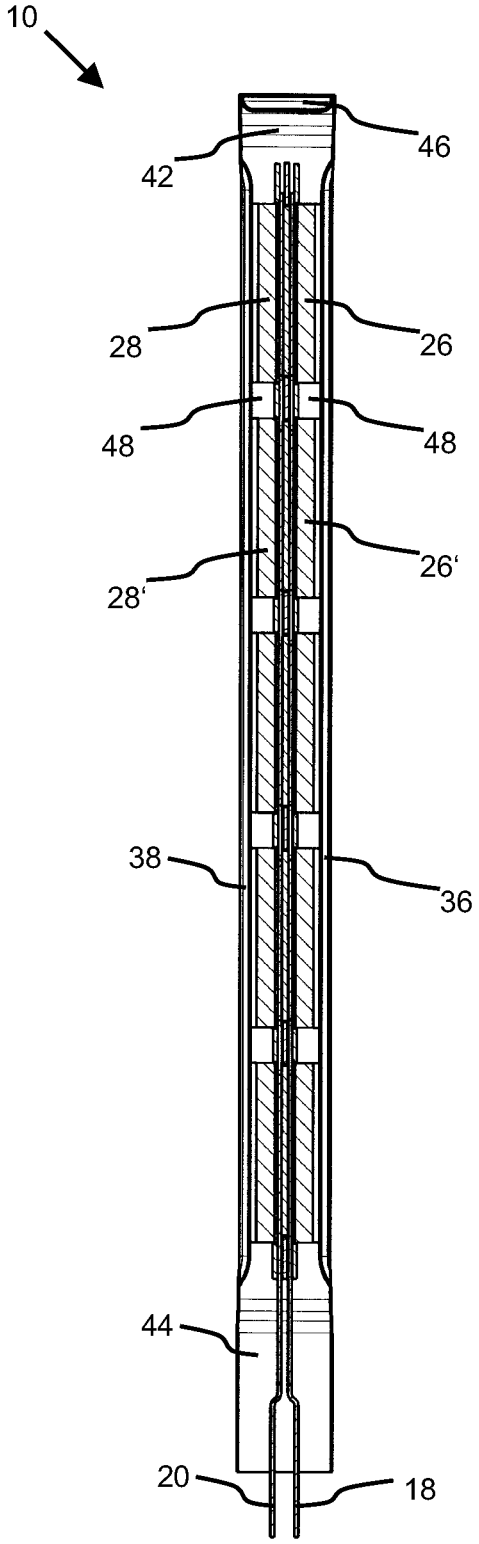
FIG. 2 a longitudinal section through the electrical heater along a line II-II in FIG. 1.

As is apparent from FIG. 2, despite the punching of the beads 36, 38, end regions 42, 44 of the housing 12 maintain their circular-cylindrical shape. This facilitates the attachment of a round bottom part 46 to the housing 12, for instance by welding. Similarly, thus, a closure part of round configuration can particularly simply be provided in the end region 44, through which the contact electrodes 18, 20 pass.

In the electrical heater 10 exemplarily shown in FIG. 2, five pairs of profile parts 26, 28, 26', 28' are disposed each opposing each other in radial direction, wherein a clearance 48 is provided between each pair. The number of the PTC thermistors 16 and of the isolators 22, 24 can, as presently, correspond to that of the pairs of profile parts 26, 28, 26', 28', whereas the contact electrodes 18, 20 are presently continuously formed—viewed over the axial length of the housing 12. In this manner, manufacturing tolerances of the PTC thermistors 16 can be particularly well compensated for. Similarly, despite of the considerably higher thermal expansion coefficient of the profile parts 26, 28 compared to that of the housing 12, a particularly good contact of the profile parts 26, 28 with the inner side of the housing 12 thus is permanently retained.

Figure 3:
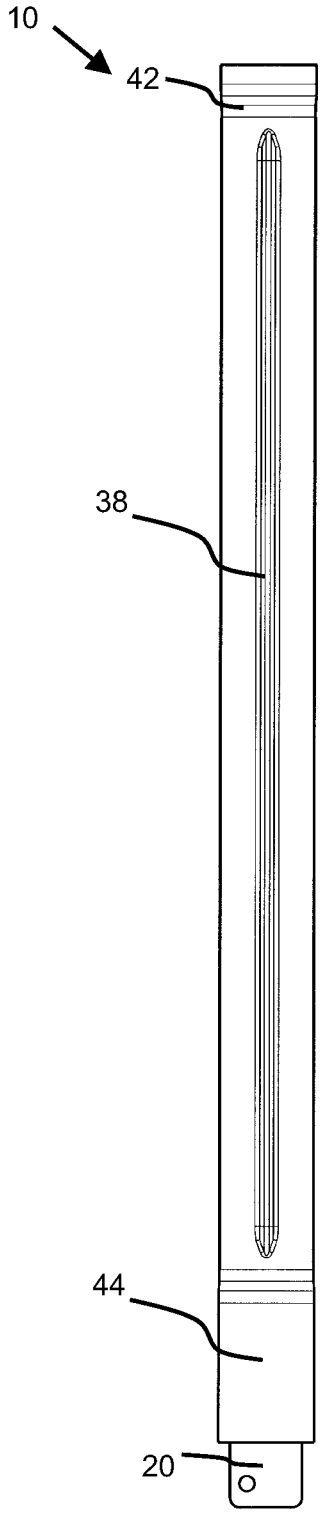
FIG. 3 the electrical heater according to FIG. 1 in a plan view.

FIG. 3 shows the electrical heater 10 in a plan view, from which the length of the bead 38 smaller compared to the axial length of the housing 12 is particularly well apparent.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

The invention claimed is:

1. An electrical heater comprising a tubular housing and a heating insert inserted in the housing, the heating insert comprising at least one PTC thermistor, the housing having at least one concave indentation, which is at least punctually in contact with a corresponding concave indentation of the heating insert, the housing being contracted around the heating insert due to forming the indentation into the housing.

2. The electrical heater according to claim 1, wherein the at least one concave indentation of the housing is formed as a bead.

3. The electrical heater according to claim 1, wherein the heating insert has at least one heat transfer portion configured to transfer heat of the at least one PTC thermistor to the housing, wherein the at least one concave indentation of the heating insert is formed in the at least one heat transfer portion.

4. The electrical heater according to claim 1, wherein the housing is formed of a steel.

5. The electrical heater according to claim 1, wherein the housing has at least one circular-cylindrical end region.

6. The electrical heater according to claim 1, wherein a length of the concave indentation of the housing is smaller than an axial length of the housing.

7. The electrical heater according to claim 1, wherein the heating insert includes at least two heat transfer portions and spaced from each other in radial direction, between which the at least one PTC thermistor is disposed.

8. The electrical heater according to claim 1, wherein the heating insert has at least two heat transfer portions, which are disposed in the housing spaced from each other in axial direction.

9. The electrical heater according to claim 1, wherein the heating insert has at least one mounting rack connected to a contact element for supplying the at least one PTC thermistor with electrical current.

10. The electrical heater according to claim 1, wherein the at least one concave indentation of the housing is spaced from a joining seam of the housing.

11. A method for manufacturing an electrical heater, the method comprising:

inserting a heating insert into a tubular housing, the heating insert comprising, at least one PTC thermistor, and subsequent to inserting the heating insert into the tubular housing, forming at least one concave indentation into the housing such that the indentation is at least punctually contacted with a corresponding concave indentation of the heating insert, and such that the housing is contracted around the heating insert due to the forming at least one concave indentation.

12. The method according to claim 11, wherein the at least one concave indentation is formed into the housing by pressurizing the housing, wherein a direction, in which the pressure is applied, coincides with a development direction of the at least one concave indentation.

13. The method according to claim 11, wherein the at least one concave indentation is formed into the housing by deepening an indentation already present in the housing before inserting the heating insert.

14. The method according to claim 11, the method further comprising, upon forming the at least one concave indentation into the housing, monitoring a pressure exerted on the housing.

15. The method according to claim 11, wherein forming at least one concave indentation into the housing comprises effecting a decrease in diameter of the housing.

* * * * *